US005152161A

United States Patent [19]

Lee

[11] Patent Number: 5,152,161

[45] Date of Patent: Oct. 6, 1992

[54] ADJUSTABLE CAM LOCK

[75] Inventor: Miko Lee, Hsinchung, Taiwan

[73] Assignees: ABA Locks Manufacturer Co., Ltd.; Jin Tay Industries Co., Ltd., Japan

[21] Appl. No.: 822,688

[22] Filed: Jan. 21, 1992

[51] Int. Cl.[5] ..... E05B 17/04

[52] U.S. Cl. ..... 70/127; 70/128; 70/379 R; 70/380; 70/461; 70/DIG. 62; 292/64; 292/212

[58] Field of Search ..... 70/127, 128, 140, 379 R, 70/379 A, 380, 461, DIG. 62; 292/58, 64, 69, 212, 336.5

[56] References Cited

U.S. PATENT DOCUMENTS

| | | | |
|---|---|---|---|
| 1,287,000 | 12/1918 | Greaves | 292/212 |
| 2,334,012 | 11/1943 | Koch et al. | 292/212 X |
| 3,146,010 | 8/1964 | Dellith | 292/212 |
| 4,358,943 | 11/1982 | Ouellet | 70/379 R X |

FOREIGN PATENT DOCUMENTS

| | | | |
|---|---|---|---|
| 353984 | 5/1922 | Fed. Rep. of Germany | 70/379 R |
| 862487 | 3/1941 | France | 292/64 |

*Primary Examiner*—Lloyd A. Gall

*Attorney, Agent, or Firm*—Leydig, Voit & Mayer

[57] ABSTRACT

A cam lock having an adjustable cam bolt. The cam lock has a tubular lock case, a tumbler, a shaft, a spring, and a cam bolt. The tubular lock case has an inner flange which divides the lock case into a first portion and a second portion which is formed with a restricting element. The tumbler is received in the first portion. The shaft is rotated by the tumbler and extends into the second portion. The spring is disposed around the shaft within the second portion. The cam bolt is mounted on the shaft by threaded engagement so as to compress the spring and has an arc-like cutoff beyond which the restricting element extends.

2 Claims, 4 Drawing Sheets

ADJUSTABLE CAM LOCK

BACKGROUND OF THE INVENTION

The present invention relates to a cam lock assembled on a front wall of a drawer or on a door of a safe or the like and, more particularly, to a cam lock with a cam bolt having an adjustable distance from the front wall.

A cam lock is generally mounted to a front wall of a drawer or the like. The rim has a tumbler and a cam bolt which is operatively attached to the tumbler. A key actuates the tumbler to drive the cam bolt to a first position where the cam bolt extends out of the cam lock, thereby preventing the drawer from being pulled out, and a second position where the cam bolt retracts into the cam lock, thereby unlocking the drawer. Currently, drawers are manufactured with front walls of different depth, i.e., various distances from the front surface of the drawer to the plane defined by rotation of the cam bolt. Apparently, there is a drawback that lock manufacturers have to produce cam locks of various sizes which lock retailer have to keep in inventory. If the lock does not fit the drawer, the drawer can be urged back and forth to some extent even when locked. The present invention is intended to eliminate the above-mentioned problem.

SUMMARY OF THE INVENTION

It is an object of the present invention to provide a cam lock having a lock case, a tumbler, a shaft, and a cam bolt.

It is another object of the present invention to provide a rotating element having a first threaded portion and a second threaded portion.

It is still another object of the present invention to provide a cam bolt having a threaded hole which is secured to the second threaded portion of the shaft.

These and additional objects, if not specifically set forth herein, will be readily apparent to those skilled in the art from the detailed description of embodiments below, with reference of the accompanying drawings.

Figure 1:
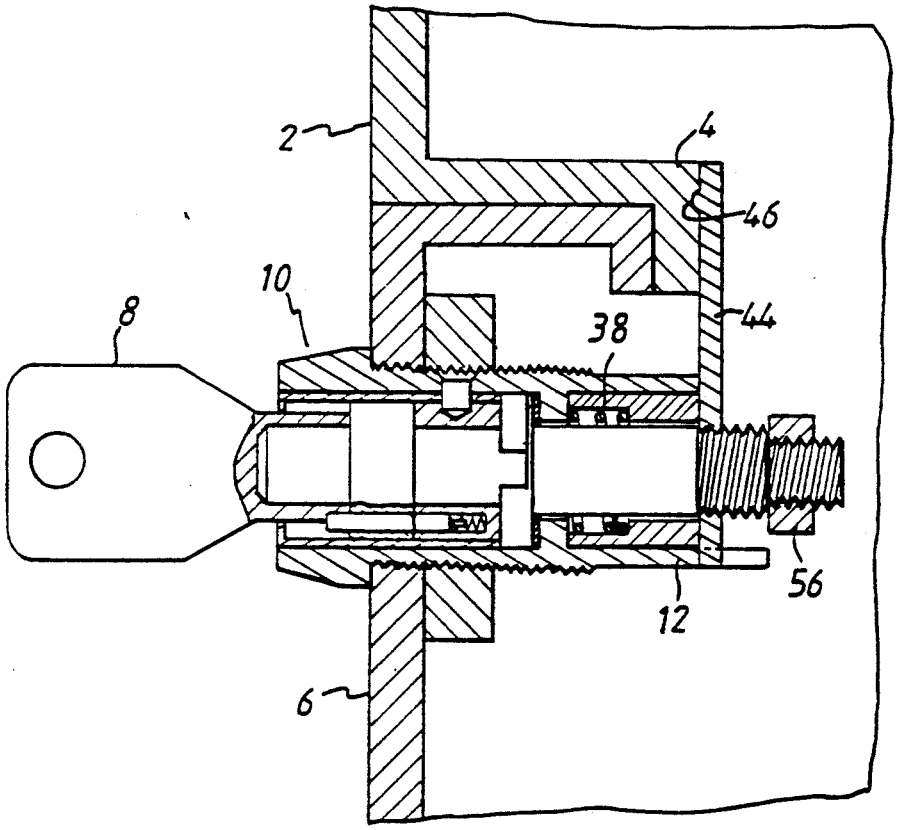
FIG. 1 is a cross-sectional view of a cam lock mounted on a front wall of a drawer as shown in a segmental view in accordance with the present invention.

Preferred embodiments described in the drawings are employed not for limitation but for illustration of the present invention.

DETAILED DESCRIPTION OF THE PREFERRED EMBODIMENT

The present invention is to be understood by description of the preferred embodiment in relation to the drawings.

Referring to the drawings and, more particularly, to FIG. 1, as shown in a partial cross-sectional view, a desk 2 is formed with an element 4 extending parallel to a front wall 6 of a drawer. A distance from an inward surface of the element 4 to an outward surface of the front wall 6 may be different with different desks. A key 8 operates in a cam lock 10 mounted in the front wall 6.

Figure 2:
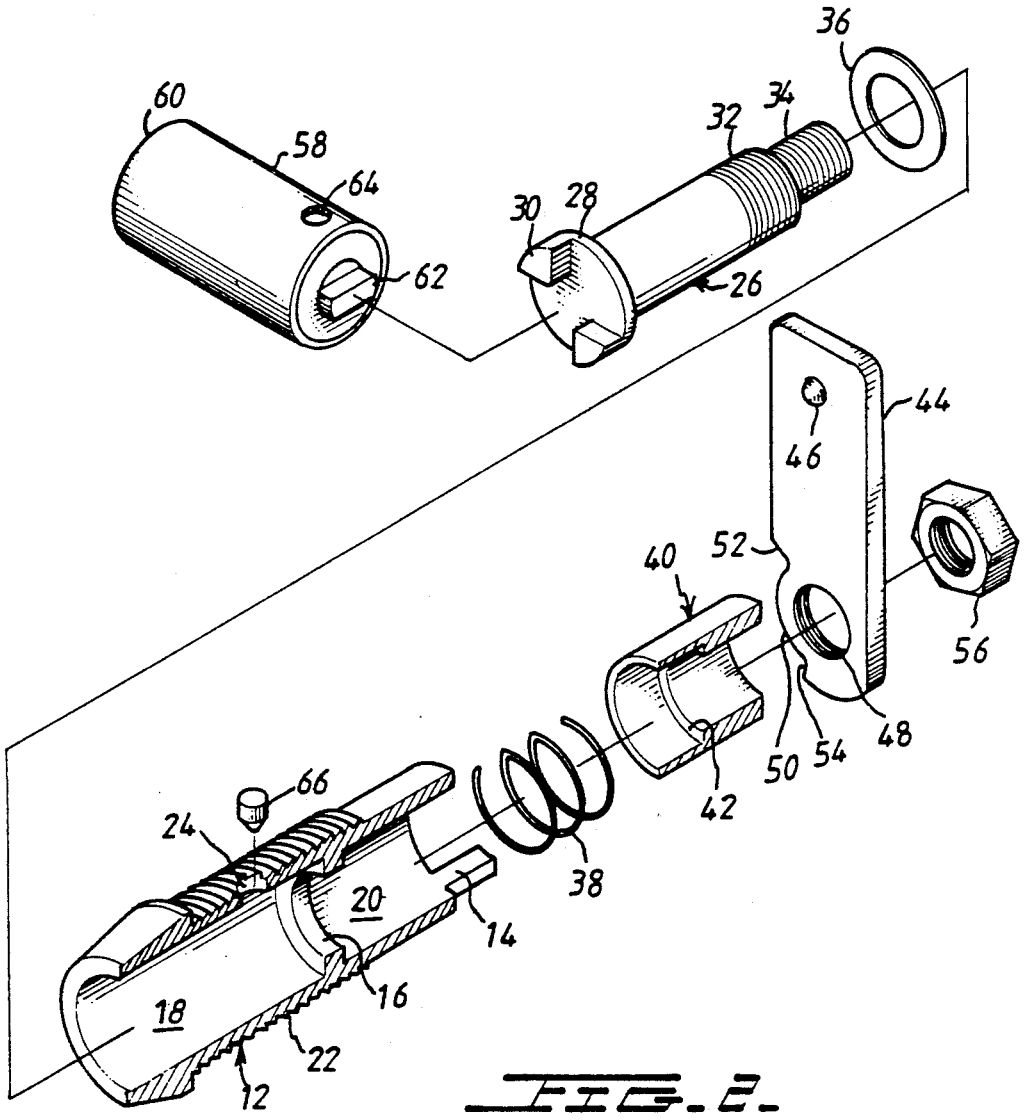
FIG. 2 is an exploded view of cam lock in accordance with the present invention.

Referring to FIG. 2, the cam lock 10 has a tubular lock case 12. The tubular lock case 12 has a first end disposed outside the front wall 6 and a second end formed with a restricting element 14 and disposed inside the front wall 6. A flange 16 extends around an inner surface of the lock case 12, thereby dividing the inside of the lock case 12 into a first portion 18 and a second portion 20. Threading 22 is formed on an outer surface of the lock case 12, so that the lock case 12 can be secured to the front wall 6 with the restricting element 14 at a lower position. A hole 24 extends through the lock case 12, thereby communicating with the first portion 18.

A shaft 26 has a disk 28 formed with two opposite protrusions 30 at a first end thereof and threading 32 at the other end thereof. A relatively small threaded rod 34 is substantially co-axially formed at the second end of the shaft 26. The shaft 26 is inserted through a washer 36 and the flange 16, so that the disk 28 is retained in the portion 18 while the disk 28 abuts the washer 36, in turn abutting the flange 16.

A spring 38 is collared on the shaft 26 and received in the second portion 20. A sleeve 40 is internally formed with a surface 42. The sleeve 40 encloses the spring 38, so that the spring 38 is compressed between the flange 16 and the face 42.

A cam bolt 44 has a protrusion 46 at a first end thereof and a threaded hole 48 at a second thereof. A cutoff 50 extends around the threaded hole 48 so as to form an unlocking face 52 at an end thereof and a locking face 54 at the other end thereof. The threaded hole 48 is secured to the threading 32, thereby engaging the cam bolt 44 to the shaft 26, so that the sleeve 40 abuts the cam bolt 44 and the restricting element 14 extends beyond the cutoff 50. A nut 56 is secured onto the threaded rod 34.

A tumbler 58 has a key-hole end 60 matching with the key 8 (see FIG. 1) and an actuating end 62 rotated by the key 8. A hole 64 is formed on a periphery of the tumbler 58, so that a pin 66 fits in the holes 24 and 64, thereby engaging the tumbler 58 to the lock case 12 when the tumbler 58 is received in the portion 18 with the actuating end 62 rotating between the protrusions 30.

It should be noted that the key 8 and the tumbler 58 can be any type which co-operates with the shaft 26. They are conventional and need no further description. The key 8 is inserted in the key-hole end 60 in order to rotate the actuating end 62, thereby urging one of the protrusions 30 to rotate the cam bolt 44 in a corresponding direction.

Figure 3:
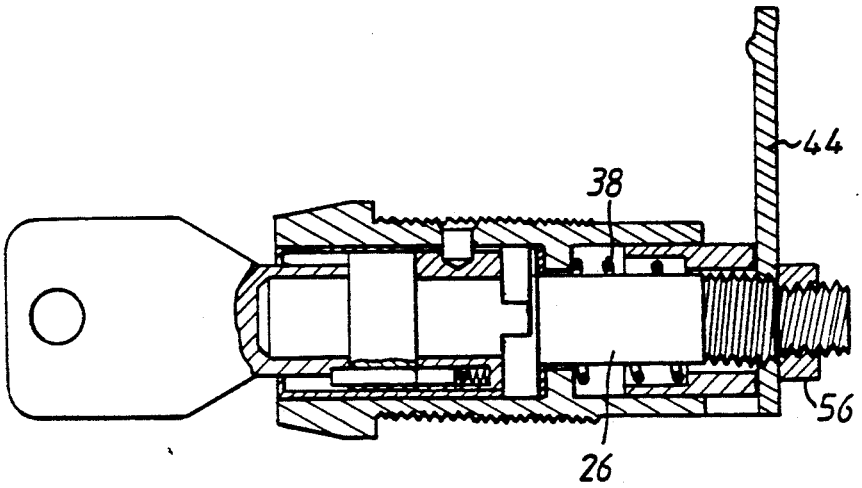
FIG. 3 is a cross-sectional view of a cam lock with a cam bolt in an extended position in accordance with the present invention.
Figure 4:
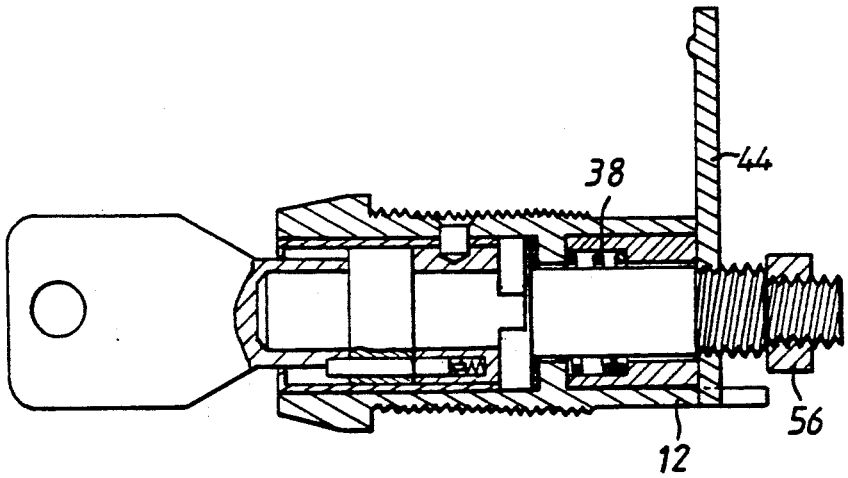
FIG. 4 is a cross-sectional view of a cam lock with a cam bolt in a retracted position in accordance with the present invention.
Figure 5:
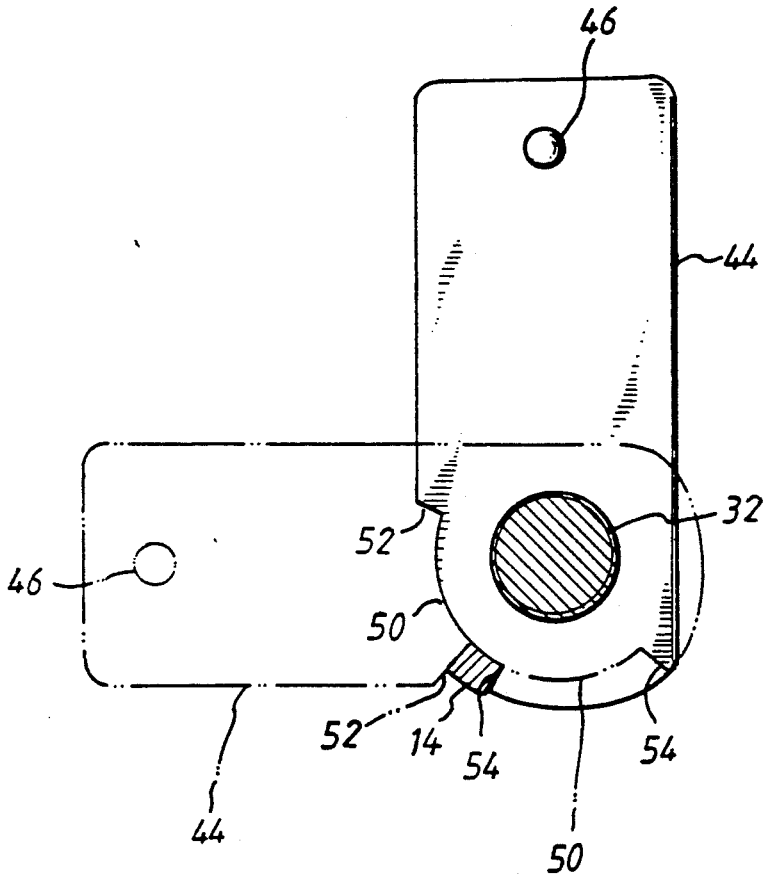
FIG. 5 is a front plane view of a cam bolt in a locking position and a unlocking position in accordance with the present invention.

Referring to FIG. 5, as the cam bolt 44 is rotated in a first direction to an unlocking position where the unlocking face 52 abuts the restricting element 14, the shaft 26 may be further rotated, so that the cam bolt 44 is urged away from the lock case 12 until it abuts the nut 56, as shown in FIG. 3. As the cam bolt 44 is rotated in a second direction to a locking position where the locking face 54 abuts the restricting element 14, the shaft 26 may be further rotated, so that the cam bolt 44 is urged toward the lock case 12 until it abuts the lock case 12, as shown in FIG. 4, or/and the element 4, where the protrusion 46 is received in a hole formed in the element 4. Therefore, the shaft 26 has to be rotated in the first direction for a few revolutions so as to allow the spring 38 to urge the cam bolt 44 toward the nut 56, thereby releasing the protrusion 46 from the hole of the element 4 so that the cam bolt 44 can be rotated. Therefore, the lock in accordance with the present invention co-operates with desks of various sizes. Furthermore, trying to pick the lock, any persons will not be able to unlock the drawer unless they learn to rotate the shaft 26 in the unlocking direction for a few revolutions in order to release the protrusion 46 from the bore in the element 4 before they are able to rotate the cam bolt 44.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A cam lock comprising:

a tubular lock case being receivable in a hole of a drawer and formed with a flange extending therein, thereby dividing said lock case into a first portion and a second portion, said second portion having a restricting element;

a tumbler defining an actuating end and residing in said first portion of said lock case for co-operating with a key in order to rotate said actuating end; a shaft having a first end operatively connected to said actuating end within said first portion, so that said shaft is rotatable by said tumbler, and a second end having threading formed thereon and being positioned within said second portion;

a spring disposed around the shaft and received in said second portion; and a cam bolt having a threaded hole being secured to said threading of said shaft, thereby engaging said cam bolt to said shaft and compressing said spring, and a cutoff extending around said threaded hole beyond which said restricting element extends.

2. A cam lock in accordance with claim 1, wherein said cam bolt comprises a protrusion which is receivable in a bore of a desk or the like, so that said shaft is rotated in an unlocking direction for a few revolutions, and that the protrusion is released from the bore, thereby allowing said cam bolt to rotate.

* * * * *

UNITED STATES PATENT AND TRADEMARK OFFICE

CERTIFICATE OF CORRECTION

PATENT NO. : 5,152,161

DATED : October 6, 1992

INVENTOR(S) : Miko Lee

It is certified that error appears in the above-identified patent and that said Letters Patent is hereby corrected as shown below:

On the title page:

Item no. [73], Assignee, change "Japan" to --Taiwan--.

Signed and Sealed this

Fourteenth Day of December, 1993

*Attest:*

*Attesting Officer*

BRUCE LEHMAN

*Commissioner of Patents and Trademarks*